US005933877A

United States Patent [19]

Wu

[11] Patent Number: 5,933,877

[45] Date of Patent: Aug. 10, 1999

[54] TOILET AND FOOT PLATE ARRANGEMENT

[76] Inventor: King-Sheng Wu, FL.12, No.47, Chin-Hwa Street, Taipei, Taiwan

[21] Appl. No.: 09/235,166

[22] Filed: Jan. 22, 1999

[51] Int. Cl.[6] ..... E03D 11/00

[52] U.S. Cl. ..... 4/254; 4/239

[58] Field of Search ..... 4/254, 246.1, 237, 4/239

[56] References Cited

U.S. PATENT DOCUMENTS

| | | | |
|---|---|---|---|
| 1,038,388 | 9/1912 | Kiessig | 4/254 |
| 1,215,104 | 2/1917 | Bonner | 4/254 |
| 2,903,714 | 9/1959 | Grondona | 4/254 |
| 4,635,303 | 1/1987 | Shih | 4/254 |
| 4,819,277 | 4/1989 | Sikirov | 4/254 |

FOREIGN PATENT DOCUMENTS

| | | | |
|---|---|---|---|
| 49620 | 11/1889 | Germany | 4/246.1 |
| 501354 | 2/1939 | United Kingdom | 4/254 |

*Primary Examiner*—Charles H. Eloshway
*Attorney, Agent, or Firm*—Bacon & Thomas, PLLC

[57] ABSTRACT

A toilet and foot plate arrangement includes two supports arranged at two opposite sides of a toilet bowl to hold a respective rotary barrel, two foot plates respectively fixedly connected to the rotary barrels at the supports, a transmission shaft suspended above the toilet bowl and coupled between the rotary barrels at the supports by a transmission, and a toilet seat and cover assembly fixedly fastened to the transmission shaft, wherein the foot plates are turned with the rotary barrels from the non-operative position to the operative position and supported on the toilet bowl when the toilet seat and cover assembly is lifted from the toilet bowl; the foot plates are turned with the rotary barrels away from the toilet bowl when the toilet seat and cover assembly is closed on the toilet bowl.

7 Claims, 4 Drawing Sheets

TOILET AND FOOT PLATE ARRANGEMENT

BACKGROUND OF THE INVENTION

The present invention relates to a toilet and foot plate arrangement which enables two foot plates to be turned inwards and supported on the toilet bowl for allowing the user to sit on the heels on foot plates. The design is practical for use in public places such as hospitals, schools, airports, railway stations, department stores, airplanes, trains, etc.

A regular toilet is generally comprised of a toilet bowl, and a toilet seat and cover assembly pivoted to the rear portion of the toilet bowl at the top. When in use, the toilet seat is closed on the toilet bowl, so that the user can sit on the seat. However, direct contact of the body with the toilet seat may cause the body to be contaminated. In order to prevent direct contact of the body with the toilet seat, people may sit on the heels on the toilet seat. However, it is dangerous to sit on the heels on the toilet seat.

SUMMARY OF THE INVENTION

The present invention has been accomplished under the circumstances in view. It is one object of the present invention to provide a toilet and foot plate arrangement which allows the user to selectively sit on the toilet seat, or on the heels on foot plates above the toilet bowl. It is another object of the present invention to provide a toilet and foot plate arrangement which prevents the body from contamination when using the toilet, and allows the user to sit on the heels above the toilet bowl safely.

According to the present invention, the toilet and foot plate arrangement comprises a toilet having a toilet bowl; at least one support means mounted at at least one side of the toilet bowl, the at least one support means each comprising fixed means, rotary means turned about the fixed means, and foot plate means fixedly connected to the rotary means and turned with the rotary means; a transmission shaft suspended above the toilet bowl; and a toilet seat and cover assembly fixedly connected to the transmission shaft and turned with the transmission shaft to cover the toilet bowl; and at least one transmission mechanism respectively coupled between the transmission shaft and the rotary means of the at least one support means, enabling the rotary means to be turned with the transmission shaft. When the toilet seat and cover assembly is lifted from the toilet bowl, the foot plate means of the at least one support means is turned with the respective rotary means from a non-operative position away from the toilet bowl to an operative position and supported on the toilet bowl. On the contrary, when the toilet seat and cover assembly is closed on said toilet bowl, the foot plate means of the at least one support means is turned with the respective rotary means from the operative position to the non-operative position away from the toilet bowl. The at least one transmission mechanism can be comprised of gear transmission means, chain transmission means, or belt transmission means. When gear transmission means is used, it can be comprised of a first bevel gear fixedly mounted on the transmission shaft and a second bevel gear fixedly mounted on the respective rotary means and meshed with the first bevel gear. The speed reducing ration is preferably 3:1, for example, the gear ratio between said first bevel gear and said second bevel gear is 3:1. Under this arrangement, the foot plate means is turned inwards through 270° angle when the toilet seat and cover assembly is turned upwards through 90° angle.

A foot rest may be provided, and pivoted to the at least one support means. The foot rest can be turned about the at least one support means to a position in front of the toilet bowl when the user steps on the foot plate means in the operative position. The at least one support means each can be comprised of two legs supported on the floor. The legs each may have a bottom end mounted with an adjustment screw for elevation adjustment. Alternatively, the at least one support means each can be comprised of two legs fixedly fastened to the floor.

DETAILED DESCRIPTION OF THE PREFERRED EMBODIMENT

Figure 1:
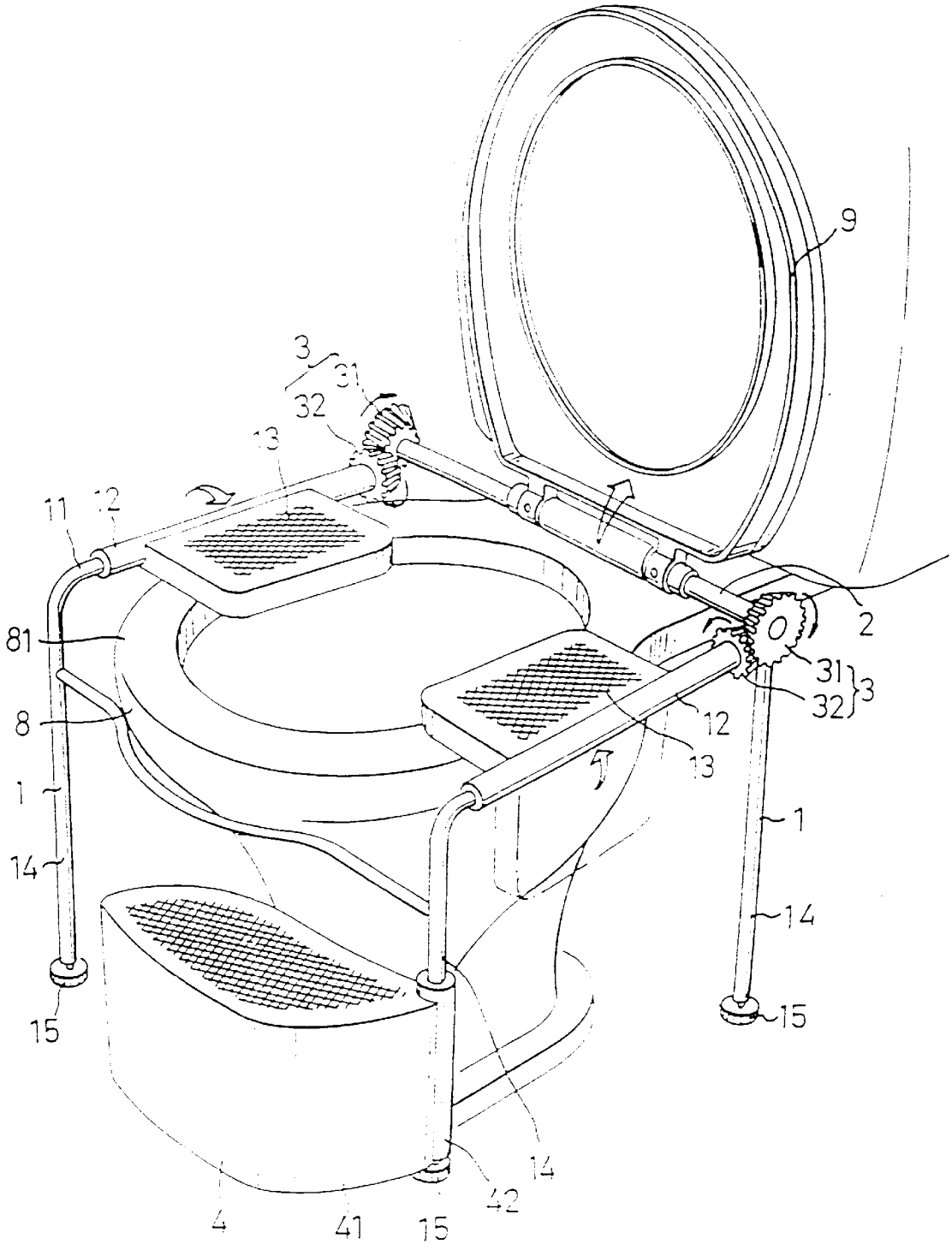
FIG. 1 is a perspective view of the present invention.
Figure 2:
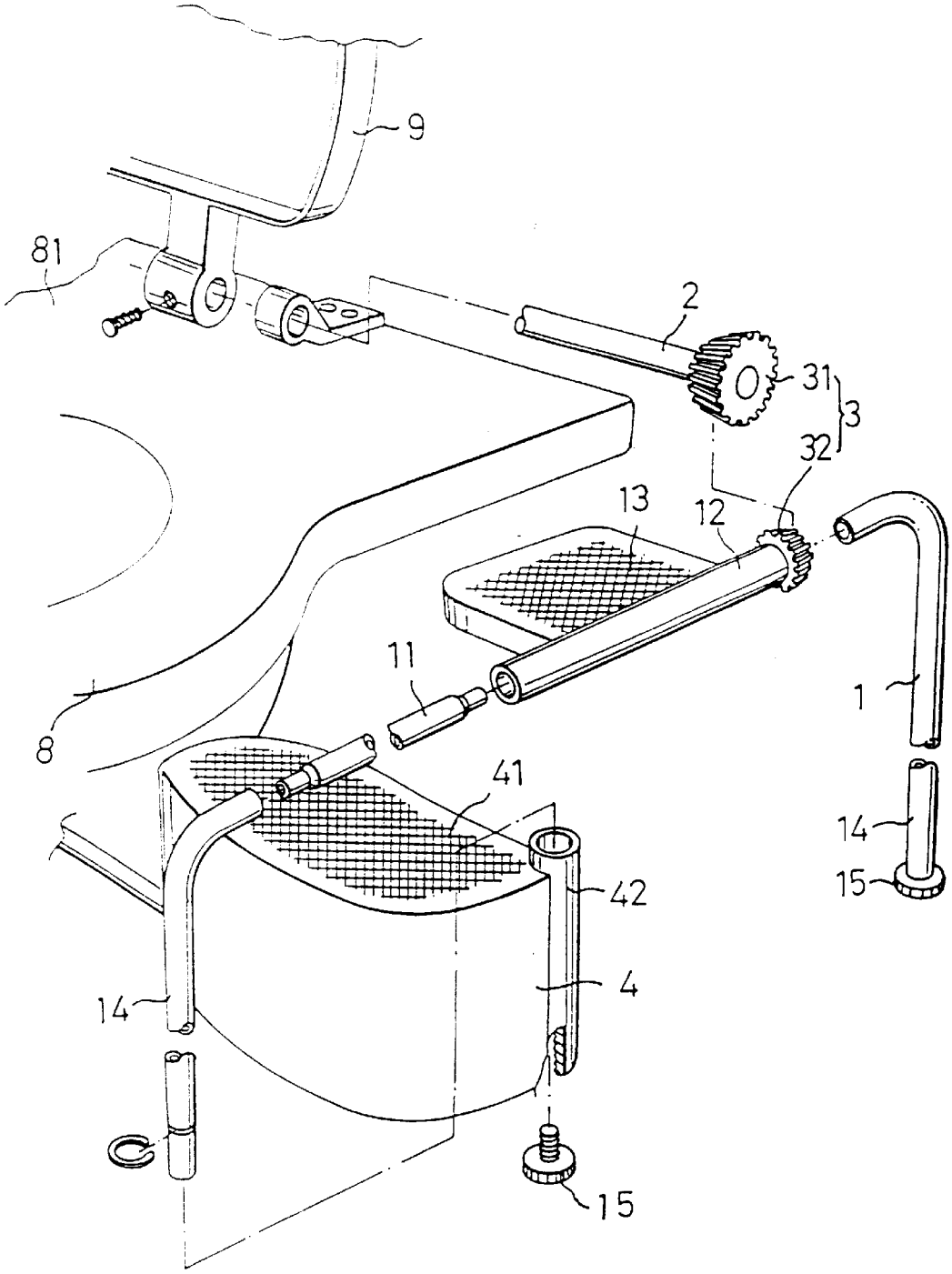
FIG. 2 is an exploded view of a part of the present invention.

Referring to FIGS. from 1 through 3, two supports 1 are arranged in parallel at two opposite sides of a toilet bowl 8. The supports 1 each comprise two legs 14 vertically supported on the floor, a pivot shaft 11 horizontally connected between and integral with the legs 14 at the top side, and a rotary member for example a rotary barrel 12 mounted on the pivot shaft 11. The legs 14 each have a bottom end mounted with an adjustment screw 15 for elevation adjustment. A foot plate 13 is respectively fixedly connected to the periphery of the rotary barrel 12 at each support 1. A foot rest 4 is coupled to one support 1 at the front side. The foot rest 4 comprises a base block 41, and a barrel 42 vertically integral with the base block 41 at one side and mounted on one leg 14 of one support 1 in front of the toilet bowl 8. The foot plates 13 can be turned about the respective pivot shafts 11 between the operative position where the foot plates 13 are respectively horizontally supported on the rim 81 of the toilet bowl, and the non-operative position where the foot plates 13 are vertically suspended from the respective pivot shafts 11 at two opposite sides of the toilet bowl 8.

Referring to FIGS. from 1 through 3 again, a transmission shaft 2 is horizontally disposed above the rear portion of the rim 81 of the toilet bowl 8. The toilet seat and cover assembly 9 is fixedly connected to the transmission shaft 2, and turned with the transmission shaft 2 between the operative position where the toilet seat and cover assembly 9 is covered on the rim 81 of the toilet bowl 8, and the non-operative position where the toilet seat and cover assembly 9 is lifted from the rim 81 of the toilet bowl.

Two transmission mechanisms 3 are coupled between the two ends of the transmission shaft 2 and the rotary barrels 12 at the support 1. The transmission mechanisms 3 each comprise a first bevel gear 31 fixedly mounted on one end of the transmission shaft 2, and a second bevel gear 32 fixedly mounted on one end of the rotary barrel 12 at one support 1 and meshed with the first bevel gear 31. The gear ratio between the first bevel gear 31 and the second bevel gear 32 is 3:1.

Figure 3:
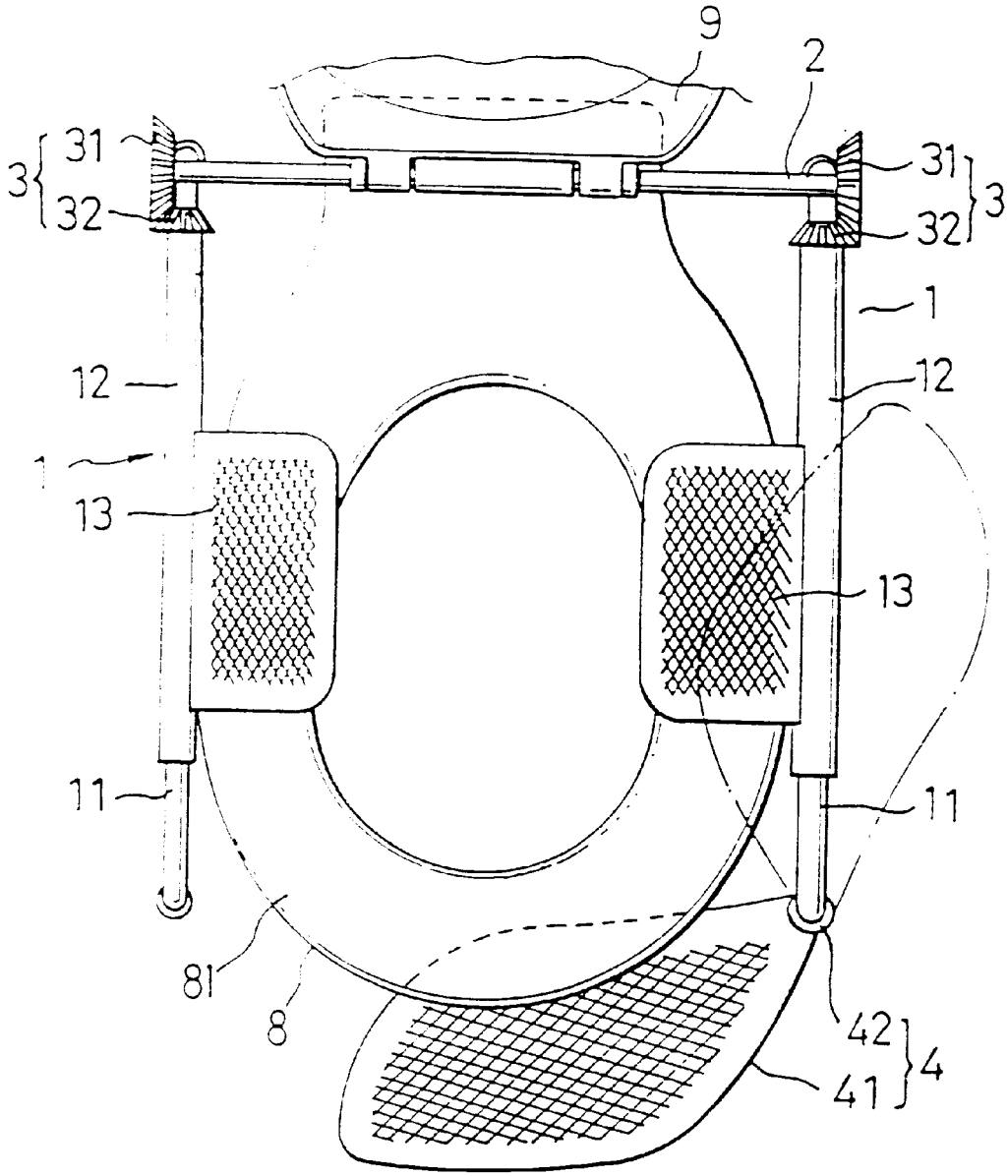
FIG. 3 is a top view of the present invention.

Referring to FIG. 1 and 3, when the toilet seat and cover assembly 9 is lifted from the rim 81 of the toilet bowl 8 from the operative position to the non-operative position, the rotary barrels 12 at the supports 1 are rotated on the respective pivot shafts 11, thereby causing the foot plates 13 to be turned about the respective pivot shafts 11 from the non-operative position to the operative position and then supported on the rim 81 of the toilet bowl 8. Because the gear ratio between the first bevel gear 31 and the second bevel gear 32 is 3:1, the foot plates 13 are respectively turned inwards through 270° angle when the toilet seat and cover assembly 9 is turned upwards through 90° angle. Therefore, when the toilet seat and cover assembly 9 is turned from the horizontal position (operative position) to the vertical position (non-operative position), the foot plates 13 are simultaneously turned from the vertical position (non-operative position) to the horizontal position (operative position). On the contrary, when the toilet seat and cover assembly 9 is turned downwards from the vertical position (non-operative position) to the horizontal position (operative position), the foot plates 13 are simultaneously turned from the horizontal position (operative position) to the vertical position (non-operative position).

Figure 4:
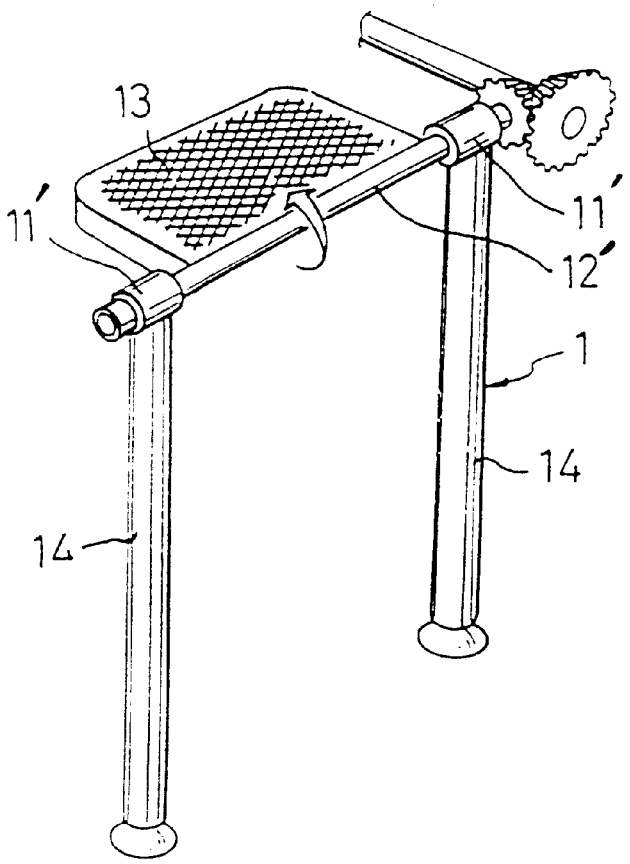
FIG. 4 is a partial view of an alternate form of the present invention.

FIG. 4 shows an alternate form of the present invention, in which the two legs 14 of the support 1 each have a barrel 11' at the top, and the foot plate 13 is fixedly connected to a pivot shaft 12', which is revolvably supported in the barrels 11' at the legs 14.

What the invention claimed is:

1. A toilet and foot plate arrangement, comprising:

a toilet having a toilet bowl;

at least one support mounted at one side of said toilet bowl; said at least one support each comprising a fixed portion, a rotary portion turned about said fixed portion, and a foot plate for supporting a user thereon, said foot plate fixedly connected to said rotary portion and turned with said rotary portion;

a transmission shaft suspended above said toilet bowl;

a toilet seat and cover assembly fixedly connected to said transmission shaft and turned with said transmission shaft to cover said toilet bowl; and at least one transmission mechanism respectively coupled between said transmission shaft and the rotary portion of said at least one support means, enabling said rotary portion to be turned with said transmission shaft;

wherein the foot plate of said at least one support is turned with the respective rotary portion from a non-operative position away from said toilet bowl to an operative position overlaying and supported on said toilet bowl when said toilet seat and cover assembly is lifted from said toilet bowl to allow the user to squat atop said toilet bowl; the foot plate of said at least one support is turned with the respective rotary portion from the operative position to the non-operative position away from said toilet bowl when said toilet seat and cover assembly is closed on said toilet bowl.

2. The toilet and foot plate arrangement of claim 1 wherein said at least one transmission mechanism each is comprised of a gear transmission.

3. The toilet and foot plate arrangement of claim 2 wherein said gear transmission is comprised of a first bevel gear fixedly mounted on said transmission shaft, and a second bevel gear fixedly mounted on the respective rotary portion and meshed with said first bevel gear.

4. The toilet and foot plate arrangement of claim 1 wherein the speed reducing ratio of said at least one transmission mechanism is 3:1.

5. The toilet and foot plate arrangement of claim 1 further comprising a foot rest pivoted to said at least one support.

6. The toilet and foot plate arrangement of claim 1 wherein said at least one support each is comprised of two legs adapted to be supported on the floor.

7. The toilet and foot plate arrangement of claim 6 wherein said legs each have a bottom end with an adjustment screw for elevation adjustment.

* * * * *